US009234333B2

(12) United States Patent
Ko

(10) Patent No.: US 9,234,333 B2
(45) Date of Patent: Jan. 12, 2016

(54) ANTI-FREEZE FAUCET

(71) Applicant: Chih Han Ko, Changhua (TW)

(72) Inventor: Chih Han Ko, Changhua (TW)

( * ) Notice: Subject to any disclaimer, the term of this patent is extended or adjusted under 35 U.S.C. 154(b) by 97 days.

(21) Appl. No.: 14/260,348

(22) Filed: Apr. 24, 2014

(65) Prior Publication Data

US 2015/0308085 A1 Oct. 29, 2015

(51) Int. Cl.
*E03B 7/12* (2006.01)
*E03B 7/10* (2006.01)

(52) U.S. Cl.
CPC ..... *E03B 7/12* (2013.01); *Y10T 137/1189* (2015.04)

(58) Field of Classification Search
CPC ..... E03B 7/12; Y10T 137/1189
See application file for complete search history.

(56) References Cited

U.S. PATENT DOCUMENTS 949,115 A * 2/1910 Davey ..... F16K 31/508 251/266
5,697,393 A 12/1997 Mirlisena, Sr.
5,992,440 A * 11/1999 Betz ..... F16K 31/508 137/15.18
7,975,720 B2 7/2011 Conway
8,613,290 B1 12/2013 Wu

* cited by examiner

*Primary Examiner* — John K Fristoe, Jr.
*Assistant Examiner* — Patrick Williams
(74) *Attorney, Agent, or Firm* — Charles E. Baxley

(57) ABSTRACT

An anti-freeze faucet includes a housing engaged into a receptacle, a check valve device engaged into the housing, a cap mounted on the housing and having an opening communicating with the check valve device, a casing attached to the cap and having a space communicating with the opening of the cap and having one or more outlet orifices, a non-circular follower is slidably engaged in a non-circular chamber of the casing for guiding the follower to move up and down along the casing, a plug is attached to the follower for blocking and opening the cap, and a shank is engaged in the casing and has a threaded segment engaged with the follower for moving the follower along the casing and for moving the plug to engage with the cap.

7 Claims, 5 Drawing Sheets

ANTI-FREEZE FAUCET

BACKGROUND OF THE INVENTION

1. Field of the Invention

The present invention relates to an anti-freeze faucet, and more particularly to an anti-freeze faucet including an improved structure for easily and quickly actuating or operating the anti-freeze faucet to open or release or to block the water flowing through the anti-freeze faucet and for increasing the working life of the anti-freeze faucet.

2. Description of the Prior Art

Typical anti-freeze faucets are normally used and worked in the frigid or freezing environment for preventing the water from being frozen and expanded within the faucet and for preventing the faucet from being broken or damaged by the frozen and expanded water, and normally comprise a valve mechanism formed or provided in the faucet for selectively and automatically releasing the water.

For example, U.S. Pat. No. 5,697,393 to Mirlisena, Sr., and U.S. Pat. No. 8,613,290 to Wu disclose two of the typical anti-freeze faucets each also comprising a valve structure or mechanism formed or provided in the faucet mechanism for selectively and automatically releasing the water and for preventing the faucet from being broken or damaged by the frozen and expanded water.

However, the water tight seal between the parts or elements may be loosen and may become failure after use, such that a water leaking problem may normally be generated after use.

U.S. Pat. No. 7,975,720 to Conway discloses another typical faucet facility or assembly also comprising a valve structure or mechanism formed or provided in the faucet for selectively and automatically releasing the water and for preventing the faucet from being broken or damaged by the frozen and expanded water during the winter season.

However, the water tight seal structure or mechanism between the parts or elements may be loosen and may become failure after use, such that a water leaking problem may normally be generated after use.

The present invention has arisen to mitigate and/or obviate the afore-described disadvantages of the conventional anti-freeze faucets.

SUMMARY OF THE INVENTION

The primary objective of the present invention is to provide an anti-freeze faucet including an improved structure for easily and quickly actuating or operating the anti-freeze faucet to open or release or block the water flowing through the anti-freeze faucet and for increasing the working life of the anti-freeze faucet.

In accordance with one aspect of the invention, there is provided an anti-freeze faucet comprising a receptacle including a first end portion and a second end portion, and including a chamber formed therein, a housing engaged into the chamber of the receptacle and located in the first end portion of the receptacle, the housing including a compartment formed therein and communicating with the first end portion of the receptacle for receiving a water from the first end portion of the receptacle, a check valve device engaged into the compartment of the housing for controlling and limiting the water to flow only from the first end portion of the receptacle into the compartment of the housing and for preventing the water from flowing backward from the compartment of the housing into the first end portion of the receptacle, a cap mounted on the housing, and including an opening formed therein and communicating with the check valve device for allowing the water from the check valve device to selectively flow through the opening of the cap, a casing attached to the cap and the housing, and including a space formed therein and communicating with the opening of the cap for receiving the water from the opening of the cap and the check valve device, and including at least one outlet orifice formed therein and communicating with the space of the casing for allowing the water to flow out of the casing and to flow into the chamber of the receptacle, and including a non-circular chamber formed in the casing and communicating with the space of the casing, a non-circular follower slidably received and engaged in the non-circular chamber of the casing for guiding and limiting the follower to move up and down along the non-circular chamber of the casing only and for preventing the follower from being rotated relative to the casing, and including an inner thread formed in the follower, a plug attached to the follower for selectively engaging with the cap and for selectively blocking and opening the opening of the cap, and a shank rotatably engaged in the casing, and including a threaded segment for engaging with the inner thread of the follower and for actuating the follower to move along the non-circular chamber of the casing when the shank is rotated relative to the casing and the follower, and for moving the plug to selectively contact and engage with the cap and to selectively block and open the opening of the cap, and for moving the anti-freeze faucet to be easily and quickly actuated or operated to open or release or to block the water flowing through the anti-freeze faucet and for increasing the working life of the anti-freeze faucet.

The cap includes an outer peripheral flange extended radially and outwardly from the cap and engaged between the housing and the casing for anchoring and positioning the cap between the housing and the casing. The cap includes an outer thread threaded and engaged with the housing and the casing.

The follower includes an outer peripheral flange extended radially and outwardly therefrom for engaging with the casing and for limiting the follower to move relative to the casing. The shank includes an outer peripheral flange extended radially and outwardly therefrom for engaging with the casing and for anchoring the shank to the casing and for preventing the shank from being moved longitudinally relative to the casing.

A knob may further be provided and coupled to the shank for rotating the shank relative to the casing and the follower. The knob includes a stem extended therefrom and coupled to the shank with a fastener for rotating the shank relative to the casing and the follower, and for actuating the plug to selectively engage with the opening of the cap.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
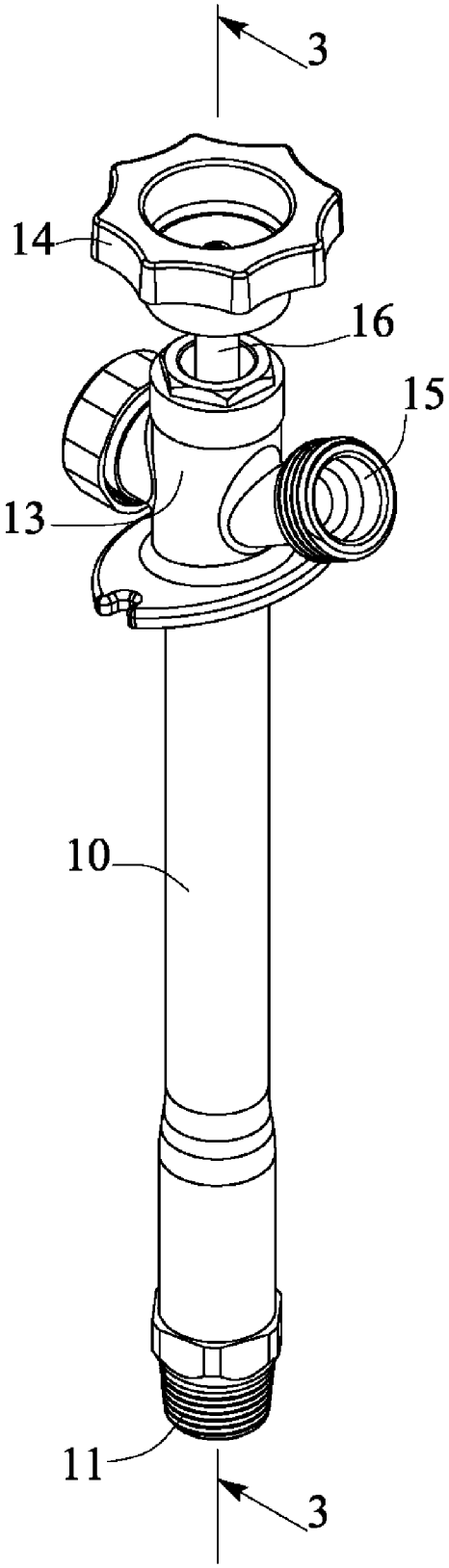
FIG. 1 is a perspective view of an anti-freeze faucet in accordance with the present invention.
Figure 2:
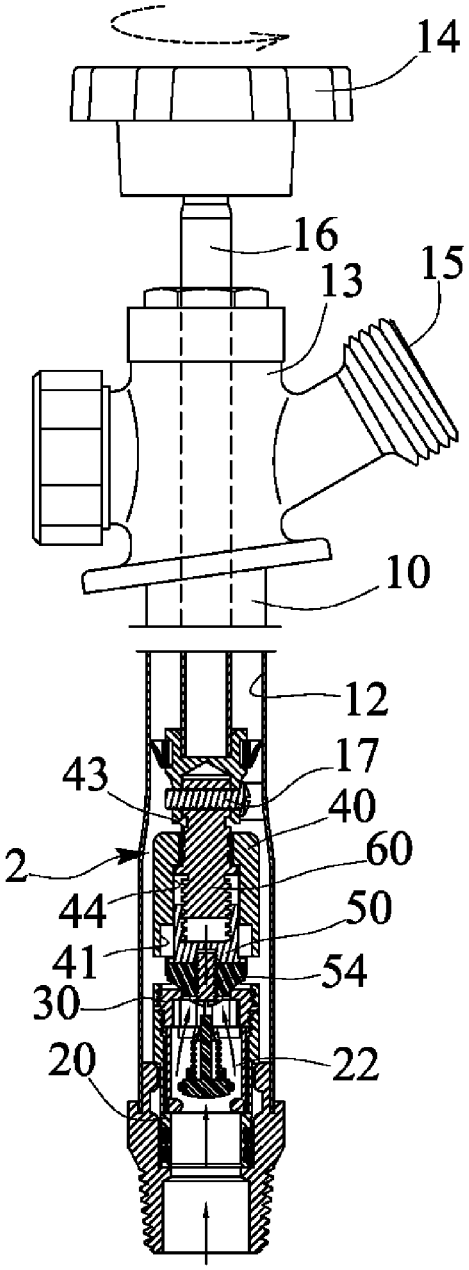
FIG. 2 is a side or front plan schematic view of the anti-freeze faucet.
Figure 3:
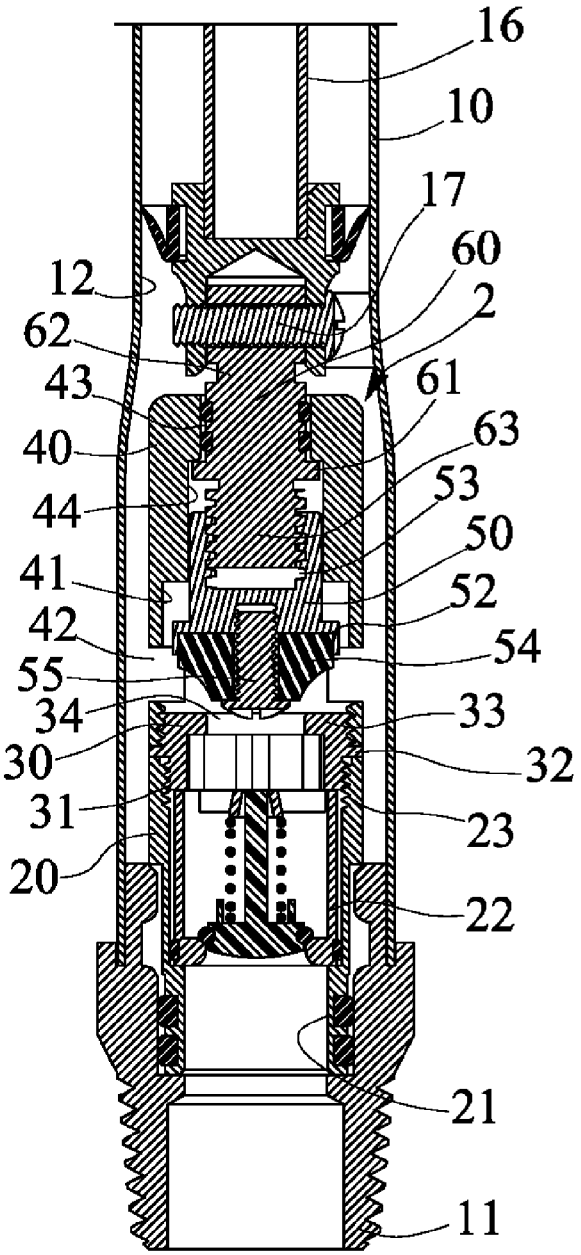
FIG. 3 is a partial cross sectional view of the anti-freeze faucet, taken along lines 3-3 of FIG. 1.
Figure 4:
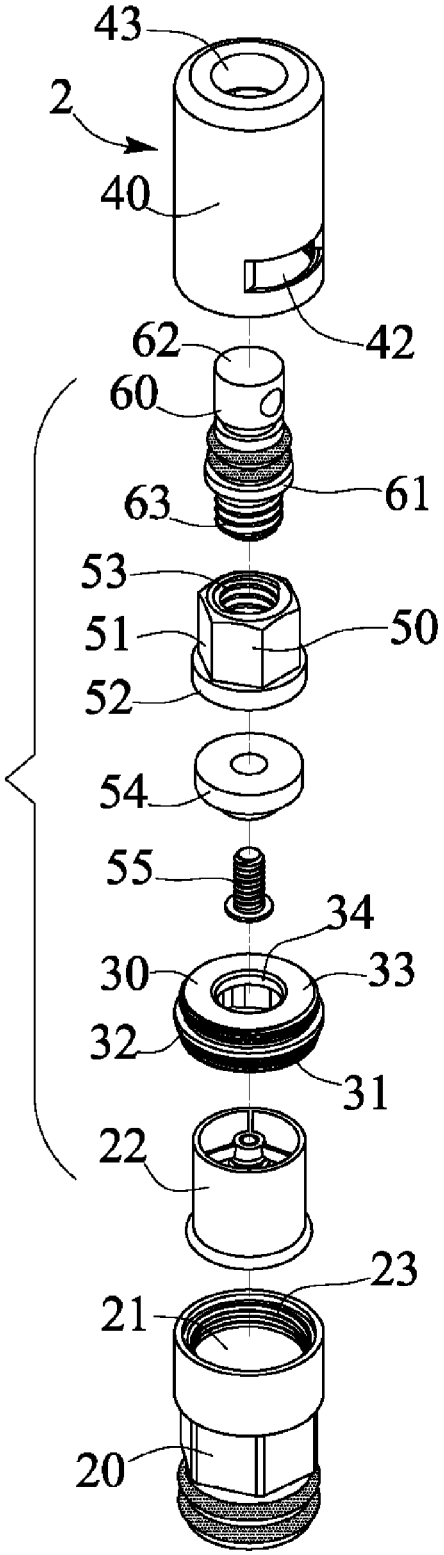
FIG. 4 is a partial exploded view of the anti-freeze faucet.

Referring to the drawings, and initially to FIGS. 1-3, an anti-freeze faucet in accordance with the present invention comprises an outer hose or conduit or cylindrical or tubular member or receptacle 10 including a one or first end portion 11 for connecting or coupling to a water tank or reservoir (not illustrated), and for receiving or obtaining the water or fluid from the water reservoir, and including a compartment or chamber 12 formed therein, and including another or second end portion 13 for receiving or engaging with a control hand grip or knob 14 which is extended or located out of the second end portion 13 of the receptacle 10. The anti-freeze faucet further includes a control structure or mechanism 2 disposed or engaged into the chamber 12 of the receptacle 10 and connected or coupled to the control knob 14 for controlling or opening or releasing or blocking the water to flow through the anti-freeze faucet.

For example, the control structure or mechanism 2 includes a base member or conduit or housing 20 disposed or engaged into the chamber 12 of the receptacle 10 and located or anchored or retained or positioned in the first end portion 11 of the receptacle 10, and the housing 20 includes a chamber or compartment 21 formed therein and communicating with the first end portion 11 of the receptacle 10 for receiving or obtaining the water from the first end portion 11 of the receptacle 10, a check valve device 22 is disposed or engaged into the compartment 21 of the housing 20 for controlling or limiting the water to flow only from the first end portion 11 of the receptacle 10 into the compartment 21 of the housing 20 (FIG. 6) and for preventing the water from flowing backward from the compartment 21 of the housing 20 into the first end portion 11 of the receptacle 10.

A lid or cap 30 includes an outer thread 31 formed or provided on the outer peripheral portion thereof for threading or engaging with the corresponding inner thread 23 of the housing 20 and for solidly and stably attaching or mounting or securing the cap 30 onto the housing 20, and includes an outer peripheral flange 32 extended radially and outwardly from the middle or intermediate portion of the cap 30 for contacting or engaging with the housing 20 and for further solidly and stably anchoring or retaining or positioning the cap 30 onto the housing 20, and includes an upper portion 33 extended and located out of the housing 20, and includes a valve seat or opening 34 formed therein and communicating with the check valve device 22 for allowing the water to flow through the cap 30. The cap 30 is contacted or engaged with the check valve device 22 for solidly and stably anchoring or retaining or positioning the check valve device 22 within the compartment 21 of the housing 20.

Another housing or cylindrical or tubular member or casing 40 is threaded or engaged with the outer thread 31 of the cap 30 for solidly and stably attaching or mounting or securing the casing 40 to the cap 30 and the housing 20, and includes a chamber or compartment or space 41 formed therein and communicating with the opening 34 of the cap 30 for receiving or obtaining the water from the opening 34 of the cap 30 and the check valve device 22 (FIG. 6), and includes one or more exits or outlet orifices 42 formed therein and communicating with the space 41 of the casing 40 for allowing the water to flow out of the casing 40 and to flow into the chamber 12 of the receptacle 10 (FIG. 6) and to selectively flow out through an outlet port 15 of the receptacle 10 (FIGS. 1, 2), and includes an aperture 43 formed in the upper portion thereof, and includes a non-circular portion or surface or chamber 44 formed in the middle or intermediate portion thereof and communicating with and located between the aperture 43 and the space 41 of the casing 40.

A sliding member or follower 50 includes a non-circular outer peripheral portion or surface 51 formed thereon and slidably received or engaged in the non-circular chamber 44 of the casing 40 for controlling or guiding or limiting the follower 50 to move up and down along the non-circular chamber 44 of the casing 40 only and for preventing the follower 50 from being pivoted or rotated relative to the casing 40, and includes an outer peripheral flange 52 extended radially and outwardly from the lower or bottom portion thereof for contacting or engaging with the casing 40 and for limiting the follower 50 to move or slide relative to the casing 40, and includes a screw hole or inner thread 53 formed in the upper portion thereof, and includes a soft or resilient plug 54 attached or mounted or secured to the lower or bottom portion thereof with a lock or fastener 55 for selectively contacting or engaging with the opening 34 of the cap 30 and for selectively blocking or enclosing or opening the opening 34 of the cap 30.

A shank 60 is pivotally or rotatably engaged in the aperture 43 of the casing 40, and includes an outer peripheral flange 61 extended radially and outwardly therefrom for selectively contacting or engaging with the casing 40 and for anchoring or retaining or positioning the shank 60 to the casing 40 and for preventing the shank 60 from being moved or slid longitudinally relative to the casing 40, and includes an upper portion 62 extended and located out of the casing 40, and includes a lower or bottom portion or threaded segment 63 formed or provided thereon for threading or engaging with the corresponding inner thread 53 of the follower 50 and for actuating or operating the follower 50 to move up and down along the non-circular chamber 44 of the casing 40 when the shank 60 is pivoted or rotated relative to the casing 40 and the follower 50, and thus for actuating or operating or moving the plug 54 to selectively contact or engage with the opening 34 of the cap 30 and to selectively block or enclose or open the opening 34 of the cap 30.

Figure 5:
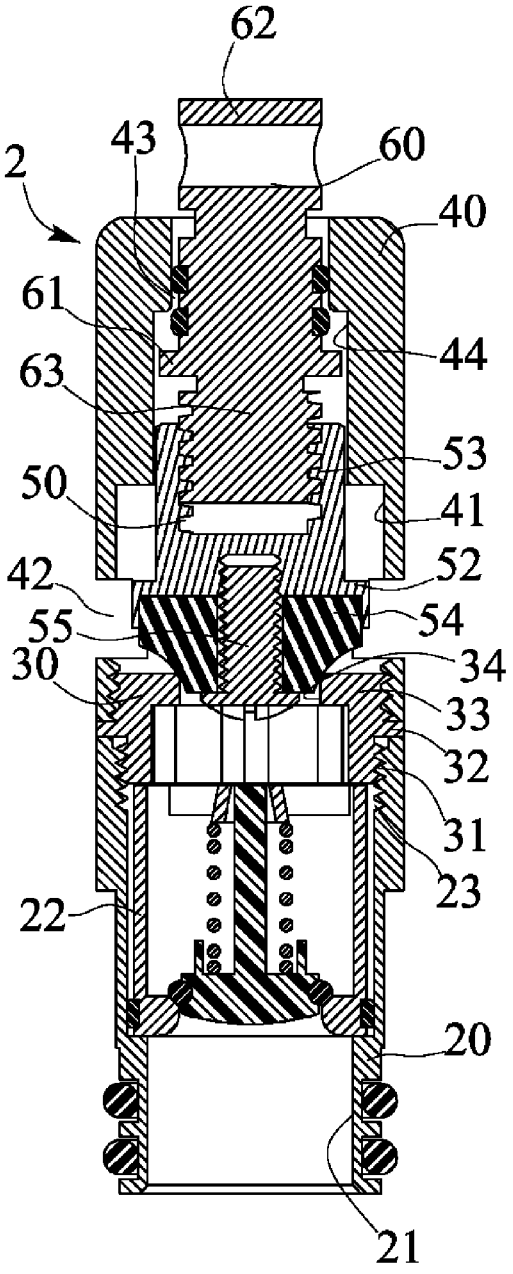
FIGS. 5, 6 are partial cross sectional views similar to FIG. 3, illustrating the operation of the anti-freeze faucet.
Figure 6:
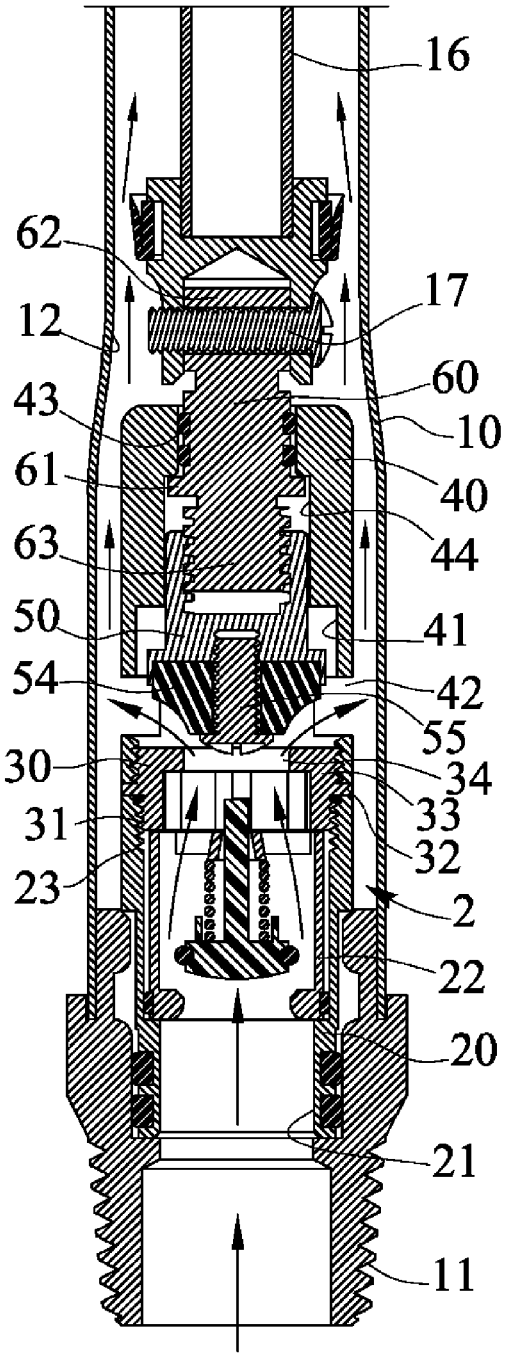
Figure 7:
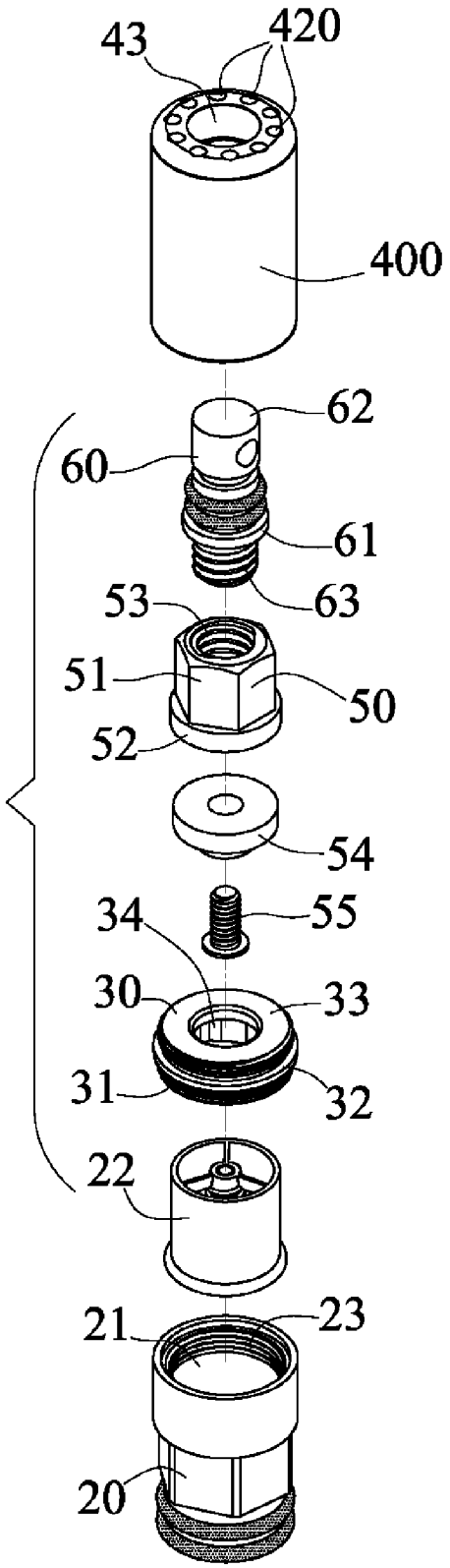
FIG. 7 is another partial exploded view illustrating the other arrangement of the anti-freeze faucet.
Figure 8:
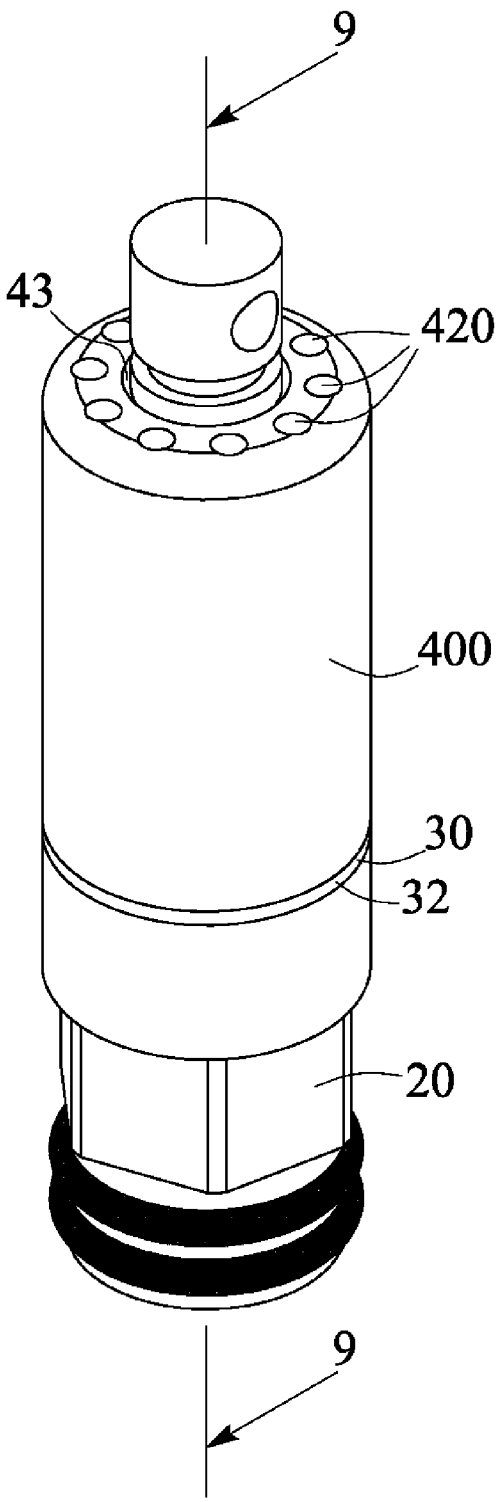
FIG. 8 is a partial perspective view of the anti-freeze faucet as shown in FIG. 7.
Figure 9:
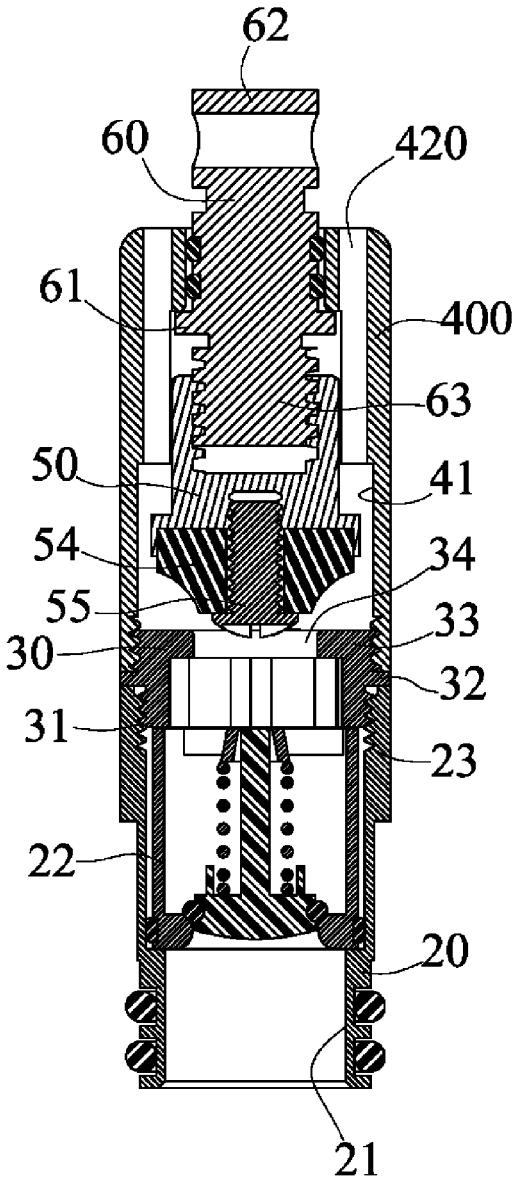
FIG. 9 is a cross sectional view of the anti-freeze faucet, taken along lines 9-9 of FIG. 8.
Figure 10:
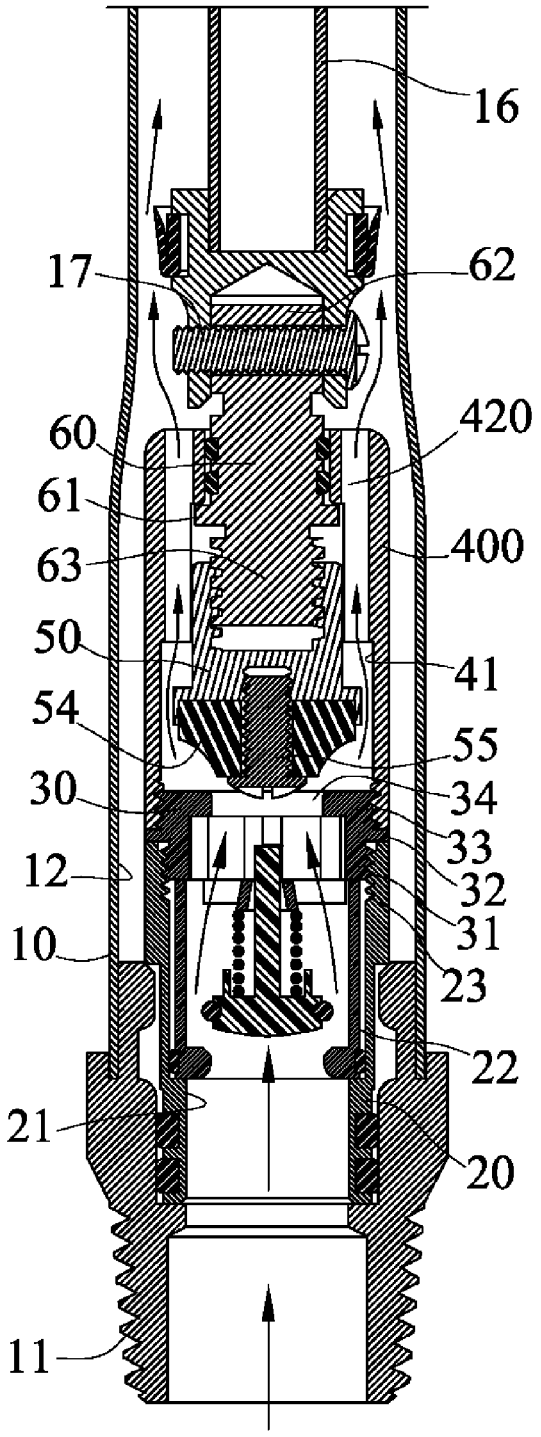
FIG. 10 is another partial cross sectional view of the anti-freeze faucet as shown in FIGS. 7-9.

The control knob 14 includes a stem 16 extended downwardly therefrom and attached or mounted or secured or coupled to the upper portion 62 of the shank 60 with a lock or fastener 17 (FIGS. 1-3) for selectively actuating or operating the shank 60 to pivot or rotate relative to the casing 40 and the follower 50, and thus for actuating or operating or moving the plug 54 to selectively contact or engage with the opening 34 of the cap 30 (FIG. 5) and to selectively block or enclose or open (FIG. 6) the opening 34 of the cap 30, and for preventing the water from flowing out through the opening 34 of the cap 30 and into the space 41 of the casing 40 and then into the chamber 12 of the receptacle 10. In operation, as shown in FIG. 6, when the plug 54 is disengaged or separated from the opening 34 of the cap 30, the expanded water contained in the water tank or reservoir or in the first end portion 11 of the receptacle 10 may force and move and open the check valve device 22 and may be released or discharged or flown out of the compartment 21 of the housing 20 and may prevent the faucet from being broken or damaged by the expanded water.

Alternatively, as shown in FIGS. 7-10, the outlet orifices 420 of the casing 400 may be formed and shaped into the other contour or shape or structure or configuration, for example, the outlet orifices 420 of the casing 400 may be formed and provided and arranged or located around the aperture 43 of the casing 40, and communicating with the space 41 of the casing 40 for allowing the water to selectively flow out of the space 41 of the casing 40 and to flow into the chamber 12 of the receptacle 10 (FIG. 10) when the water selectively flows out through the opening 34 of the cap 30 and into the space 41 of the casing 40.

Accordingly, the anti-freeze faucet in accordance with the present invention includes an improved structure for easily and quickly actuating or operating the anti-freeze faucet to open or release or block the water flowing through the anti-freeze faucet and for increasing the working life of the anti-freeze faucet.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An anti-freeze faucet comprising:

a receptacle including a first end portion and a second end portion, and including a chamber formed therein, a housing engaged into said chamber of said receptacle and located in said first end portion of said receptacle, said housing including a compartment formed therein and communicating with said first end portion of said receptacle for receiving a water from said first end portion of said receptacle, a check valve device engaged into said compartment of said housing for controlling and limiting the water to flow only from said first end portion of said receptacle into said compartment of said housing and for preventing the water from flowing backward from said compartment of said housing into said first end portion of said receptacle, a cap mounted on said housing, and including an opening formed therein and communicating with said check valve device for allowing the water from said check valve device to selectively flow through said opening of said cap, a casing attached to said cap and said housing, and including a space formed therein and communicating with said opening of said cap for receiving the water from said opening of said cap and said check valve device, and including at least one outlet orifice formed therein and communicating with said space of said casing for allowing the water to flow out of said casing and to flow into said chamber of said receptacle, and including a non-circular chamber formed in said casing and communicating with said space of said casing, a non-circular follower slidably received and engaged in said non-circular chamber of said casing for guiding and limiting said follower to move up and down along said non-circular chamber of said casing only and for preventing said follower from being rotated relative to said casing, and including an inner thread formed in said follower, a plug attached to said follower for selectively engaging with said cap and for selectively blocking and opening said opening of said cap, and a shank rotatably engaged in said casing, and including a threaded segment for engaging with said inner thread of said follower and for actuating said follower to move along said non-circular chamber of said casing when said shank is rotated relative to said casing and said follower, and for moving said plug to selectively contact and engage with said cap and to selectively block and open said opening of said cap.

2. The anti-freeze faucet as claimed in claim 1, wherein said cap includes an outer peripheral flange extended radially and outwardly from said cap and engaged between said housing and said casing for anchoring and positioning said cap between said housing and said casing.

3. The anti-freeze faucet as claimed in claim 1, wherein said cap includes an outer thread threaded and engaged with said housing and said casing.

4. The anti-freeze faucet as claimed in claim 1, wherein said follower includes an outer peripheral flange extended radially and outwardly therefrom for engaging with said casing and for limiting said follower to move relative to said casing.

5. The anti-freeze faucet as claimed in claim 1, wherein said shank includes an outer peripheral flange extended radially and outwardly therefrom for engaging with said casing and for anchoring said shank to said casing and for preventing said shank from being moved longitudinally relative to said casing.

6. The anti-freeze faucet as claimed in claim 1, wherein a knob is coupled to said shank for rotating said shank relative to said casing and said follower.

7. The anti-freeze faucet as claimed in claim 6, wherein said knob includes a stem extended therefrom and coupled to said shank with a fastener for rotating said shank relative to said casing and said follower, and for actuating said plug to selectively engage with said opening of said cap.

* * * * *